US005333881A

United States Patent [19]

Cugliari

[11] Patent Number: 5,333,881

[45] Date of Patent: Aug. 2, 1994

[54] GAME TRACKING AND WEAPON LOCATING DEVICE

[76] Inventor: Gregory A. Cugliari, 675 Case Rd., Neshanic Station, N.J. 08853

[21] Appl. No.: 5,884

[22] Filed: Jan. 15, 1993

[51] Int. Cl.[5] ..... F42B 6/04

[52] U.S. Cl. ..... 273/416

[58] Field of Search ..... 273/416, 418–420

[56] References Cited

U.S. PATENT DOCUMENTS

| | | | |
|---|---|---|---|
| 736,051 | 0/1903 | Adams | 124/88 |
| 3,497,994 | 12/1968 | Rohrbaugh, Jr. | 273/418 |
| 3,617,060 | 11/1971 | Iezzi | 273/418 |
| 3,993,311 | 11/1976 | Johnson | 273/420 |
| 4,651,999 | 3/1987 | Sturm | 273/416 |
| 4,744,347 | 5/1988 | Dodge | 273/416 X |
| 4,836,557 | 6/1989 | Polando | 273/416 |
| 4,858,935 | 8/1989 | Capson | 273/416 |
| 4,976,442 | 12/1990 | Treadway | 273/416 |
| 5,188,373 | 2/1993 | Ferguson et al. | 273/416 X |

*Primary Examiner*—Paul E. Shapiro

[57] ABSTRACT

A tracking device (20) for use in combination with a spear shaped weapon (10) comprising a tracking line (24), a discharging dart (40), a tracking line housing (30), a trigger line (22), a spear shaped weapon insert (50), a spear shaped weapon tail end (70), and a trigger line clip (60). The tracking line (24) is center wound and held inside the tracking line housing (30). The tracking line housing (30) is positioned inside the spear shaped weapon (10). The discharging dart (40) is held by the tracking line housing (30). The trigger line (22) flows from outside of the spear shaped weapon (10), where it is attached to the trigger line clip (60), to inside the spear shaped weapon (10), where it is detachably connected to the discharging dart (40). The trigger line (22) flows into the spear shaped weapon (10) through an aperture in the spear shaped weapon insert (56). In this manner, when the spear shaped weapon (10) penetrates the game the discharging dart (40) is expelled from the spear shaped weapon (10) through an aperture in the spear shaped weapon tail end (72). The tracking line (24), which is connected to the discharging dart (40), is expelled from the spear shaped weapon (10) along with the discharging dart (40) and the tracking line (24) will than begin to track the position of the spear shaped weapon (10).

14 Claims, 4 Drawing Sheets

GAME TRACKING AND WEAPON LOCATING DEVICE

BACKGROUND

1. Field of Invention

The present invention relates generally to spear shaped weapons. The spear shaped weapons are generally used for hunting or fishing. More particularly, the present invention relates to a game tracking and weapon locating device for use in combination with a spear shaped weapon (including arrows, spears, harpoons, darts, and other similarly shaped weapons). Even more particularly, the present invention pertains to game tracking and weapon locating devices for tracking to the position of the weapon which has been launched.

2. Description of Prior Art

Game tracking and weapon locating devices for use in combination with spear shaped weapons (including arrows, spears, harpoons, darts, and other similarly shaped weapons) generally comprise a tracking line which is coupled with the spear shaped weapon and the tracking line is paid out from a launching device which is used to launch the weapon. The pay out devices of the prior art are generally mounted to the launching device ( Archery Bow, etc. ) and proximate the launching device's center so as not to disturb its balance. However, placement of the pay out device proximate the mid point of the launching device can interfere with the aim and launching of the weapon. Moreover, the pay out device and the line being paid out both inhibit the movement and alter the direction of the weapon. The hunter is limited to the distance he can shoot due to the effects of the trailing line which is being paid out. Therefore, as an example, an archer who is capable of shooting game at a distance of 50 yards will be limited to shots of approximately 20 to 25 yards when using the prior art products. The drop of the spear shaped weapon caused by the pay out device can vary from shot to shot resulting in a less accurate weapon.

Further, tracking lines of the prior art generally have an exposed line which hangs down from the weapon to the pay out container holding the line. This exposed line can unwind due to a loose condition of the line or can unwind due to the line catching on a branch, bush, or the like. In the case of an archer, the line sometimes unwinds when the archer is drawing his bow. This premature unwinding renders the line tracker inoperative until and unless the hunter rewinds the line or the excess is cut off and an appropriate length of line between the pay out container and the weapon is again utilized. The hunter must be continuously aware of the exposed line in order to avoid entanglement or unwinding. It is often difficult for the hunter to concentrate on the game tracking device when the hunter's concentration is primarily focused on the game which has unexpectedly appeared. Further, after the weapon is launched, the trailing line can catch on brush or other surfaces when in flight. This will cause the weapon to deviate from its intended course. Further, since the game tracking devices cause the weapon to decrease in speed, this decrease in speed results in less penetration when the game is hit.

Further, if the hunter hits the game and the game runs off pulling the line from the pay out container, the line will sometimes break. The line breaks because the full length of the line is pulled when the game runs off.

Since the full length of the dispensed portion of the line is pulled when the game runs off, the line will break if any section of the dispensed line gets entangled on brush or the like.

Further, if the hunter hits the game and the game runs off pulling out the entire length of the line, the hunter will not have additional line for a subsequent shot unless such hunter has kept an additional supply of line available.

Further, frequently the hunter misses the first shot and is given a second opportunity at the same animal. When this occurs the hunter will be required to take the second (or third or forth, etc.) shot without the use of the game tracker. It will be necessary to take the subsequent shots without the game tracker since it is generally not possible to reassemble the game tracker quickly enough and without significant hunter movement.

Further, when the hunter misses his target, the hunter needs to snip off the dispensed portion of the line and tie the new end to a second weapon. This is necessary because the hunter can not rewind the dispensed portion of the line. In the case of archery, the line is generally tied near the tip. The tip is usually a razor sharp hunting tip. Usually the hunting tip will need to be loosened or removed in order to tie the line. Accordingly, tieing the line can be dangerous, especially if the archer is situated 10 to 20 feet high in a small portable hunting tree stand and if the archer has to perform this procedure while standing, holding his bow, and without the proper tools and equipment. Some hunters are unwilling to perform this procedure under these normal hunting conditions and therefore they will not have the game tracker attached when presented with the next opportunity.

Further, in certain cases the game tracking device will need to be disconnected from the hunters equipment while the hunter transports the equipment in a vehicle. This results in continuous assembly and disassembly of the game tracking device.

Further, in certain cases the spear shaped weapon will fall out of the game causing the tracking device to stop. The hunter is then required to pursue the hit game without the use of a tracking device.

Further, tracking devices of the prior art make noise as they pay out of the pay out devices. This noise sometimes alerts and alarms the game prior to the spear shaped weapon hitting its intended target. This noise will sometimes enable the game to react and retreat safely.

DISCLOSURE OF THE INVENTION

According to the present invention there is provided a game tracking device for use in combination with a spear shaped weapon. The tracking device comprises a tracking line which is positioned inside the spear shaped weapon and which is secured at a free end to a dart. The dart is also positioned inside the spear shaped weapon and the dart is expelled from the spear shaped weapon upon the spear shaped weapon penetrating the game. The tracking line, which is connected to the dart, begins to pay out of the spear shaped weapon when the tracking line is pulled out of the spear shaped weapon by the dart.

The dart is held in place within the spear shaped weapon by a housing. A trigger line, which is a second line that is detachably connected to the dart on one free end and connected to a clip on the second free end, pulls the dart out of the spear shaped weapon when the spear shaped weapon is penetrating the game. The clip, which is connected to the trigger line, is positioned external to the spear shaped weapon. The trigger line, which is connected to the clip on the outside of the spear shaped weapon, flows into the spear shaped weapon and is detachably connected to the dart.

Accordingly, several objects and advantages of my invention are:

(a) to provide a tracking device for a spear shaped weapon wherein a tracking line is not paid out until after the weapon has hit its target.

This change will eliminate the problems regarding the placement of the pay out device on the launching equipment and the corresponding problem regarding balance and aiming interference. Additionally, this change will eliminate the problem of the line being paid out inhibiting the movement and altering the direction of the weapon. The hunter will also be able to shoot unlimited distance without interference from a tracking line and each shot by the hunter will fly exactly the same. Since there is no trailing line during flight there is no line which can get caught on a branch, bush or the like. The deflection caused by a trailing line would cause the weapon to deviate from its intial course. Since the weapon speed will not be decreased by a trailing line, the penetration of the weapon will not be reduced. Although in certain cases the weapon speed will be reduced by the weight of the line which is housed within the weapon, this weight will generally result in increased penetration and also increased stability and accuracy of the spear shaped weapon. Since the tracking line will not pay out until after the game is hit there is no noise prior to the game being hit.

(b) to provide a tracking device for a spear shaped weapon which does not have an exposed line connecting from the weapon to the pay out device.

This change will eliminate the problem of an exposed line unwinding due to a loose condition of a line or unwinding due to the line catching on a branch, bush or the like. This change will also eliminate the need for the hunter to concentrate on avoiding interference with the exposed line especially when an opportunity to shoot arises.

(c) to provide a tracking device for spear shaped weapons where the line pays out form the spear shaped weapon instead of paying out of a pay out device which is attached to the launching device.

This change will reduce the possibility of the line breaking once the game is running off. Since the prior art pays out from the pay out device which is attached to the launching device, the game will drag the entire length of the line until the game expires. Enabling the line to be paid out from the weapon will eliminate the line from dragging. As the game runs off the line will pay out from the weapon, resulting in no drag. In situations where the line gets entangled on a branch, bush or the like, the prior art line will break, whereas my tracking device will continue to pay out from the weapon without interruption.

(d) to provide a tracking device for spear shaped weapons where all the parts of the tracking device are contained on or within the body of the spear shaped weapon.

This change will eliminate the need to keep an additional supply of line available. Each spear shaped weapon contains a full length of line within its body. This change will also enable the hunter to take a second (or third or fourth, etc.) shot at the game without any hesitation or preparation. Since each spear shaped weapon is preassembled with the tracking device and since each weapon is self contained and operates independently, the hunter will need to do no additional procedures while hunting. Additionally, no further assembly or disassembly is necessary after the intial assemble.

(e) to provide a tracking device for a spear shaped weapon which continues to track game even after the spear shaped weapon has been pulled out of the game.

This change will enable hunters to continue to have the benefit of following a tracking line even after the spear shaped weapon has fallen out of the game.

Further objects and advantages of my invention will become apparent from consideration of the drawings and ensuing description.

BRIEF DESCRIPTION OF THE DRAWINGS (An Easton XX78 Arrow (spear shaped weapon) is reflected herein for illustrative purposes only)

In the drawings, closely related figures have the same number but different alphabetic suffixes.

REFERENCE NUMERALS IN DRAWINGS

Figure 1:
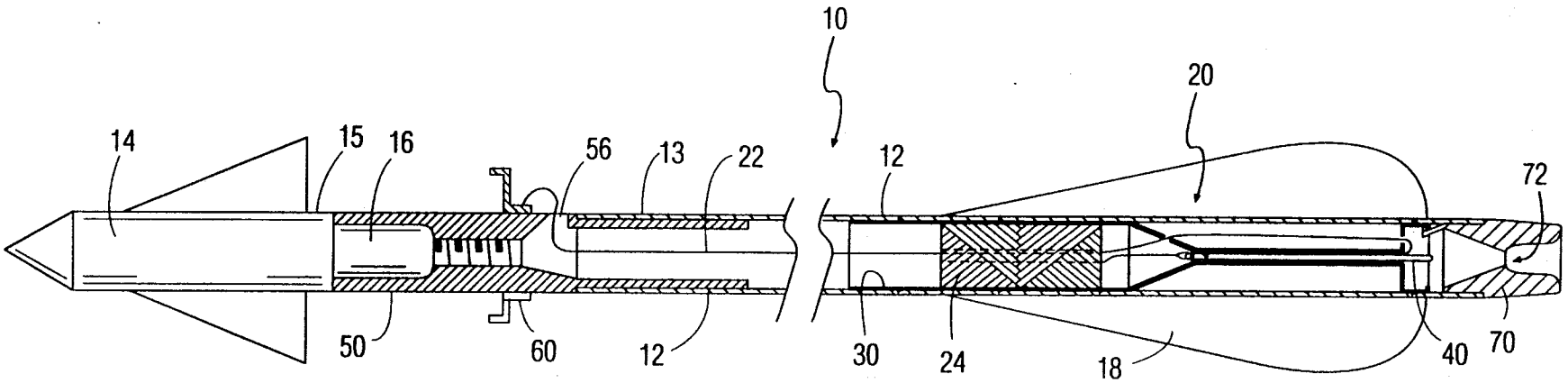
FIG. 1 is a cut-out perspective view of a tracking device installed in a spear shaped weapon.

10 spear shaped weapon
12 spear shaped weapon shaft
13 spear shaped weapon front end of shaft
14 spear shaped weapon tip
15 spear shaped weapon tip base
16 spear shaped weapon tip insert
18 spear shaped weapon vanes
20 assembled tracking device
21 trigger line free end
22 trigger line
23 trigger line loop
24 tracking line
25 tracking line free end
30 tracking line housing
31 tracking line housing tube
32 tracking line housing longitudinal split
33 tracking line housing funnel
**33*a*** a tracking line housing funnel aperture
34 tracking line housing dart tube 35 tracking line housing front tube base
35a a tracking line housing front tube base aperture
36 tracking line housing cut-outs
37 tracking line housing front tube
38 tracking line housing lip
40 discharging dart
41 discharging dart shaft
42 discharging dart slot
44 discharging dart slot blockage
45 discharging dart tail end
46 discharging dart bristles
48 discharging dart aperture
50 spear shaped weapon insert
52 spear shaped weapon insert back
54 spear shaped weapon insert tip aperture
56 spear shaped weapon insert trigger line aperture
60 trigger line clip
62 trigger line clip base
64 trigger line clip arm
66 trigger line clip aperture
68 trigger line clip split
70 spear shaped weapon tail end
72 spear shaped weapon tail end aperture
74 spear shaped weapon tail end clamp
80 second clip
82 second clip aperture
84 second clip shaft

DETAILED DESCRIPTION OF PREFERRED EMBODIMENT

Referring now to the drawings, wherein like reference numerals designate identical or corresponding parts throughout the several views, FIG. 1 shows a spear shaped weapon (10) with an assembled tracking device (20) attached. The spear shaped weapon (10) is an Easton XX78 Arrow, but it is to be understood that any type of spear shaped weapon could have a tracking device (20) attached thereto. The spear shaped weapon (10) is comprised of a tail end (70) which is attached to a hollow shaft (12). Attached to the front end of the spear shaped weapon shaft (12) is a spear shaped weapon insert (50). A spear shaped weapon tip (14) is screwed securely into the spear shaped weapon insert (50). Attached to the spear shaped weapon shaft (12) near the spear shaped weapon tail end (70) are generally spear shaped weapon vanes (18).

Figure 2:
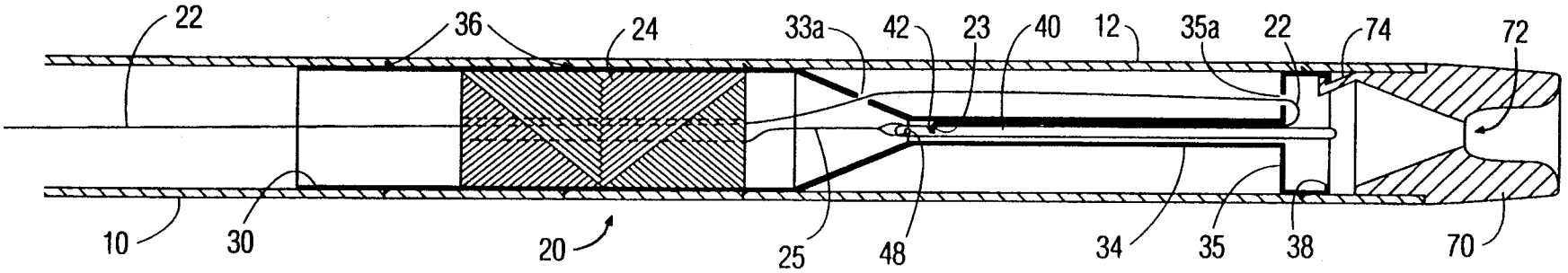
FIG. 2 is a cut out perspective view of a tail end of a spear shaped weapon with the tracking device inserted therein.

Embodied within the spear shaped weapon (10) is the assembled tracking device (20). The assembled tracking device (20) is comprised of a tracking line (24), a tracking line housing (30), a discharging dart (40), a trigger line (22), and a trigger line clip (60). In the preferred embodiment, the tracking line (24) is center wound into a spool such that the tracking line free end (25), reflected in FIG. 2, is paid out from the center of the spool. In this manner, tangling and other restrictions of the movement of the tracking line (24) are avoided. The tracking line housing (30) holds the tracking line (24) securely in spear shaped weapon shafts (12) of varying sizes. In cases where the tracking line (24) fits securely in the spear shaped weapon shaft (12) without the aid of the tracking line housing (30), the portion of the tracking line housing (30) which holds the tracking line (24) can be eliminated. In this case the tracking line (24) will be housed by the spear shaped weapon shaft (12). The discharging dart (40) is placed longitudinally inside the tracking line housing (30), and extends outside the tracking line housing (30) and into the spear shaped weapon tail end (70), but not extending to the outside of the spear shaped weapon tail end (70). The trigger line (22) extends from the trigger line clip (60) to the discharging dart (40). Upon penetration of the spear shaped weapon (10), the trigger line clip (60) will stay on the outside of the game while the spear shaped weapon (10) continues to penetrate the game. This will cause the trigger line (22) to be pulled out of the spear shaped weapon insert trigger line aperture (56) and therefore cause the discharging dart (40) to be expelled from the spear shaped weapon (10). The discharging dart (40) is expelled from the spear shaped weapon (10) through the spear shaped weapon tail end aperture (72). The tracking line (24), which is connected to the discharging dart (40), will now begin to feed out of the spear shaped weapon (10) through the spear shaped weapon tail end aperture (72).

The embodiment presented herein utilized an Easton XX78 Arrow for illustrative purposes. When employing this embodiment to other spear shaped weapons, slight modifications to the spear shaped weapon tail end (70) and spear shaped weapon insert (50) may be necessary since different spear shaped weapons have different tail end and front end designs. Although slight modifications may be required, the important characteristic of the spear shaped weapon tail end (70) and the spear shaped weapon insert (50) can always be utilized. As an example, a standard XX75 aluminum arrow (not presented) will require a hole to be placed in the tail end of the aluminum shaft to allow the discharging dart (40) to be expelled. Although slight modification to the spear shaped weapon insert (50) may also be necessary, it is to be understood that any type of spear shaped weapon could have the tracking device (20) attached thereto.

Figure 6:
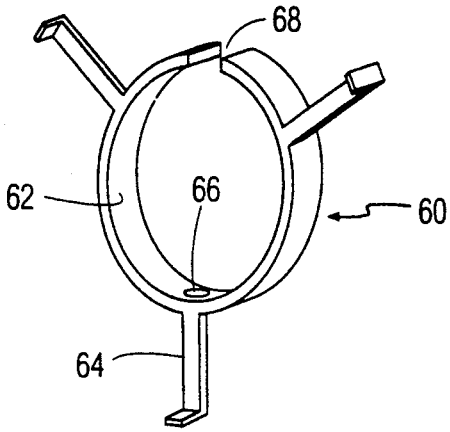
FIG. 6 is a perspective view of a trigger line clip.
Figure 9:
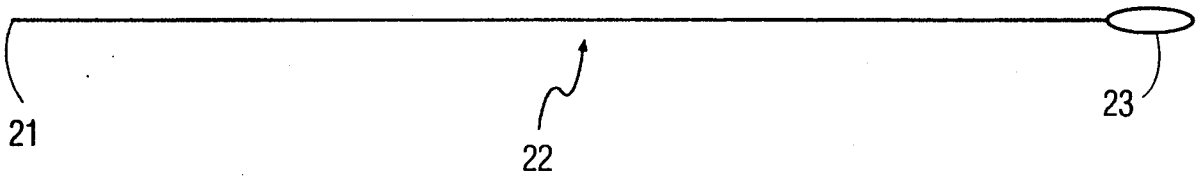
FIG. 9 is a perspective view of a trigger line.

FIG. 2 is a cut out perspective view of the tail end of a spear shaped weapon (10) with the assembled tracking device (20) inserted inside the spear shaped weapon (10). The tracking line housing (30) is securely held within the spear shaped weapon shaft ( 12 ) by the tracking line housing cut-outs ( 36). Additionally, the tracking line housing ( 30 ) is precluded from sliding longitudinally within the spear shaped weapon shaft (12) since the spear shaped weapon tail end clamp (74) is securely attached to the tracking line housing lip (38). The tracking line housing (30) holds the tracking line (24) firmly. The discharging dart (40) is held within the tracking line housing dart tube (34). The tracking line free end (25) is partly unspooled and securely tied to the discharging dart aperture (48). When the discharging dart (40) is expelled from the spear shaped weapon (10) the tracking line (24) will continue to be tied to the discharging dart (40) and will begin to feed out of the spear shaped weapon tail end aperture (72). The discharging dart (40) is expelled from the spear shaped weapon (10) by the trigger line (22). The trigger line (22), which is illustrated in FIG. 9, is connected to the trigger line clip (60), as illustrated in FIG. 1 and FIG. 6. The trigger line ( 22 ) flows into the spear shaped weapon shaft (12) through the spear shaped weapon insert trigger line aperture (56), as illustrated in FIG. 1. The trigger line ( 22 ) then runs longitudinally through the spear shaped weapon shaft (12) and into the open center of the tracking line (24). The trigger line (22) continues through the open center of the tracking line (24) and flows through the tracking line housing funnel aperture (33a), then flows through the tracking line housing front tube base aperture (35a) then flows back into the tracking line housing dart tube (34), and flows longitudinally to the discharging dart slot (42). At the discharging dart slot (42), the trigger line loop (23), which has a shape similar to a hanging noose, is slipped into the discharging dart slot (42). As the spear shaped weapon (10) is penetrating the game, the trigger line clip (60), reflected in FIG. 1 and FIG. 6, will be pulled back toward the spear shaped weapon tail end (70). This will cause the trigger line (22), which is in the spear shaped weapon shaft (12), to be pulled longitudinally toward the spear shaped weapon insert (50), as reflected in FIG. 1. As the trigger line (22) is being pulled toward the spear shaped weapon insert (50), the discharging dart (40) will be pulled out of the spear shaped weapon tail end aperture (72). When the discharging dart slot (42) is even with the tracking line housing front tube base (35), the trigger line loop (23) will dislodge from the discharging dart slot (42) and the discharging dart (40) will be free to fly out of the spear shaped weapon tail end aperture (72). Since the discharging dart (40) will have the tracking line (24) attached, the tracking line (24) will feed out of the spear shaped weapon tail end aperture (72) once the discharging dart (40) has been expelled from the spear shaped weapon (10).

The tracking line (24) can be any suitable size, strength, color or length. The tracking line spooling method which is considered the best mode for this invention is line which is center wound into a spool such that the tracking line pays out from the center of the spool. To enhance the length of the tracking line (24) and to increase the speed of unspooling, several spools of tracking line (24) can be tied together in a progressive manner. As one spool unwinds, the next spool will start. The progressive method could be used to (a) enhance the balance of the spear shaped weapon (10) (the spools can be separated in the tracking line housing (30)), (b) achieve the desired length of tracking line (24), (c) achieve the desired strength of the tracking line (24), and (d) increase the speed of unwinding (individual spools will be shorter which allows the line to unspool more freely). The tracking line (24) can also employ an alternative spooling method which would spool the line around a small rod and the line could be unspooled from the outermost layer. This outerfeed unspooling method is not deemed to be the best mode of the invention and therefore it is not presented herein.

The trigger line (22) can be made of any suitable strength line. The trigger line (22) can be replaced by other methods of expelling the discharging dart (40) and expelling the tracking line (24). Some other methods include a spring propelled triggering mechanism, a rubber band propelled triggering mechanism, and an explosive triggering mechanism. The trigger line method is considered the best mode for the invention since it reduces the overall weight of the tracking device (20) and it avoids premature, accidental and unintentional discharging of the dart, which could result in an injury. The trigger line (22) method is felt to be the best and safest mode of the invention.

It is also possible for the discharging dart (40) to be expelled out of the side of the spear shaped weapon (10) near the spear shaped weapon vanes (18), reflected in FIG. 1. The tracking line (24) will also feed out of the same aperture in the side of the spear shaped weapon (10). This is also not considered the best mode for the invention and therefore it is not presented herein.

Figure 3:
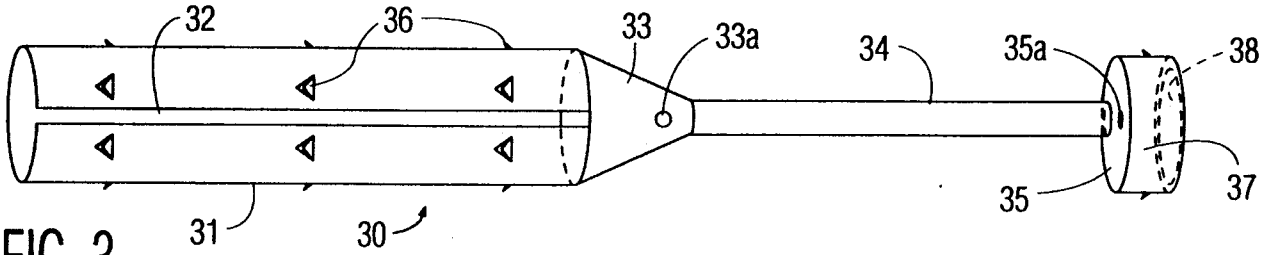
FIG. 3 is a perspective view of a tracking line housing.

FIG. 3 is a perspective view of the tracking line housing (30). The tracking line housing (30) can be made of any suitable material. The tracking line housing (30) is comprised of a tracking line housing tube (31), a tracking line housing longitudinal split (32), a tracking line housing funnel (33), a tracking line housing dart tube (34), tracking line housing cut-outs (36), a tracking line housing front tube (37) and a tracking line housing lip (38). The tracking line housing tube (31) is a cylindrical tube with an open end to accept the tracking line (24) and an opposite end which connects to the tracking line housing funnel (33). There are tracking line housing cut-outs (36) on the tracking line housing tube (31) and a tracking line housing split (32) longitudinally on the tracking line housing tube (31). The tracking line longitudinal split (32) allows the tracking line housing (30) to be spread apart sufficiently to allow the tracking line (24) to be easily inserted, presented in FIG. 2. The tracking line housing funnel (33) is used as a guide for the tracking line (24) when the tracking line (24) is pulled toward the tracking line housing front tube (37) from the tracking line housing tube (31). The tracking line housing funnel (33) is a cone shaped tube with the large end of the cone connected to the tracking line housing tube (31) and the small end of the cone connected to the tracking line housing dart tube (34). A tracking line housing funnel aperture (33*a*) is located on the tracking line housing funnel (33). The tracking line housing funnel aperture (33*a*) allows the trigger line (22) to feed through of the tracking line housing tube (31). The tracking line housing dart tube (34) is a longitudinal tube which has a smaller diameter than the tracking line housing tube (31). The tracking line housing dart tube (34) houses the discharging dart (40) prior to the discharging dart (40) ejecting and also guides the discharging dart (40) while ejecting. The tracking line housing dart tube (34) is attached to the tracking line housing funnel (33) at one end and tracking line housing front tube base (35) at the other end.

The tracking line housing front tube base (35) is flat and disc shaped. The tracking line housing front tube base (35) has an aperture in the center where it is connected to the tracking line housing dart tube (34). The tracking line housing front tube base (35) has a second aperture (35*a*) where the trigger line (22) flows through. This second aperture is called the tracking line housing front tube base aperture (35*a*). The trigger line (22) flows through the tracking line housing front tube base aperture (35*a*) then flows back into the tracking line housing dart tube (34). The space between the tracking line housing front tube base aperture (35*a*) and the center aperture on tracking line housing front tube base (35) acts as a pulley for the trigger line (22) when the trigger line (22) is being pulled. Connected to the tracking line housing front tube base (35) outer edge is the tracking line housing front tube (37).

The tracking line housing front tube (37) is a tube with the same diameter as the tracking line housing tube (31). The tracking line housing front tube (37) also has tracking line housing cut-outs (36) which are used to hold the tracking line housing front tube (37) section of the tracking line housing (30) securely in the spear shaped weapon shaft (12). The tracking line housing front tube (37) is connected to the tracking line housing front tube base (35) on one end and the tracking line housing front tube (37) has an open end with a tracking line housing lip (38).

The tracking line housing lip (38) is as small lip at the open end of the tracking line housing front tube (37). The tracking line housing lip (38) is perpendicular to the tracking line housing front tube (37). The purpose of the tracking line housing lip (38) is to secure the tracking line housing (30) against any longitudinal movements within the spear shaped weapon shaft (12). As the tracking line housing (30) is positioned into the rear most side of the spear shaped weapon shaft (12), the tracking line housing lip (38) will slide under the spear shaped weapon tail end clamp (74), presented in FIG. 7, and will fasten securely to the spear shaped weapon tail end (70), presented in FIG. 1 and FIG. 7.

The tracking line housing cut-outs (36) are v shaped cuts in the tracking line housing (30). The v shaped cuts are bent toward the outside of the tracking line housing (30). The tracking line housing cut-out (36) are flexible and contract as the tracking line housing (30) is inserted into the spear shaped weapon shaft (12). The tracking line housing cut-outs (36) assure that the tracking line housing (30) will fit snugly in varying size spear shaped weapons (10).

The tracking line housing (30) can be made in different sizes and different lengths. The tracking line housing tube (31) can be extended to accommodate more than one tracking line (24). The width or the length of the tracking line housing dart tube (34) can vary depending on the length and width of the discharging dart (40). In situations where it is preferable to reduce the overall weight of the tracking line housing (30), the tracking line housing dart tube (34) can be substantially shortened and the back end of the discharging dart (40) can be held within the open center of the tracking line (24).

Figure 4:
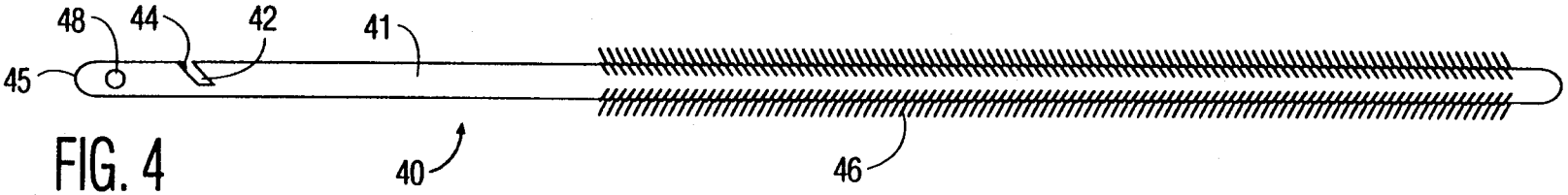
FIG. 4 is a perspective view of a discharging dart.

FIG. 4 is a perspective view of the discharging dart (40). The discharging dart (40) is a spear shaped cylindrical rod. The discharging dart (40) can be made of any suitable material. The discharging dart (40) is comprised of a discharging dart shaft (41), a discharging dart slot (42), discharging dart slot blockage (44), discharging dart bristles (46) and a discharging dart aperture (48). The discharging dart shaft (41) is a long, slender rod of sufficient size and weight to pull the tracking line .(24) out of the spear shaped weapon shaft (12). The discharging dart slot (42) is a cut out portion of the discharging dart shaft (41) which allows the trigger line loop (23) to be inserted into the discharging dart shaft (41). The discharging dart slot (42) is cut diagonally into the discharging dart shaft (41) on an angle going towards the front of the discharging dart (40). The placement of the discharging dart slot (42) should be in relative close proximity to the tail end of the discharging dart (45). The discharging dart slot (42) can also be located on the back of the discharging dart (40) similar to an arrow nock design ( see reference numeral (70) for an example). The trigger line loop (23) will remain in the discharging dart slot (42) and will cause the discharging dart (40) to be pulled out of the tracking line housing dart tube (34) when the spear shaped weapon (10) is penetrating the game. The trigger line loop (23) is held within the discharging dart slot (42) by a bump, referred to as the discharging dart slot blockage (44), but the discharging dart slot blockage (44) will allow the trigger line loop (23) to disengage from the discharging dart (40) when the discharging dart (40) has been pulled out of the tracking line housing dart tube (34). Accordingly, after the trigger line loop (23) has been disengaged from the discharging dart slot (42), the discharging dart (40) will be free to proceed through the spear shaped weapon tail end aperture (72). An alternative method to the discharging dart slot blockage (44) would be to have the discharging dart slot (42) to be a V shaped cut into the discharging dart (40). The wide end of the V will be on the outside of the discharging dart (40). This V shaped slot will result in the trigger line loop (23) fitting snugly in the inner part of the slot.

The front portion of the discharging dart (40) is covered with soft bristles (46). The purpose of the discharging dart bristles (46) is to hold the discharging dart (40) in place in the tracking line housing dart tube (34) prior to discharging. The discharging dart bristles (46) could be replaced by other means of holding the discharging dart (40). Another method of holding the discharging dart (40) within the tracking line housing dart tube (34) would be to have the discharging dart bristles (46) replaced with several long pin like arms. The pin like arms would lay flat against the discharging dart shaft (41) and open slightly after the discharging dart (40) is expelled from the spear shaped weapon (10). The pin like arms open slightly in a manner similar to a partially opened umbrella. This alternative method would allow the discharging dart (40) to be held securely in the tracking line housing dart tube (34) and would have the added benefit of causing the discharging dart (40) to get caught on brush, branches, or the like, after the discharging dart (40) has been discharged. This will cause the tracking line (24) to feed out of the spear shaped weapon (10) even quicker than if the discharging dart (40) was equipped with the discharging dart bristles (46).

Other alternative methods can be employed in order to hold the discharging dart (40) within the tracking line housing dart tube (34). The other methods could also achieve additional benefits for different types of spear shaped weapons (10) depending on the type of spear shaped weapon (10) used and the game which is pursued.

The discharging dart aperture (48) is at the tail end of the discharging dart (40) and is used to allow the tracking line (24) to be tied to the discharging dart (40). The discharging dart aperture (48) can be any suitable size in order to accommodate the size of the tracking line (24).

The discharging dart (40) can have several different uses. As an example, if the spear shaped weapon (10) is used for marine life ( fish, whales, etc.) the discharging dart (40) can be equipped with an automatically inflating balloon. The balloon will inflate when the discharging dart (40) is discharged from the spear shaped weapon (10). In this case, the discharging dart (40) should discharge when the spear shaped weapon (10) hits the water, not the marine life. This will avoid the loss of the spear shaped weapon (10) when the marine life is missed. Additionally, only a short length of tracking line (24) should be allowed to feed out loosely, the remaining tracking line (24) should have a slight drag while unwinding. This will avoid the entire tracking line (24) to unwind when the marine life is missed.

The discharging dart (40) can be any suitable length or width. The discharging dart slot (42) can be located anywhere on the back portion of the discharging dart (40). The discharging dart slot (42) can also be located on the back of the discharging dart (40) similar to the spear shaped weapon tail end (70) as reflected in FIG. 1. The discharging dart bristles (46) can be replaced with other suitable methods of holding the discharging dart (40) within the tracking line housing dart tube (34), as previously explained. The method used to hold the discharging dart (40) within the tracking line housing dart tube (34) will usually depend on the type of spear shaped weapon (10) used, the game being pursued, and the speed at which the tracking line (24) should unwind.

In certain cases it may not be necessary to use the discharging dart (40) as a means for expelling the tracking line (24) out of the spear Shaped weapon (10). One alternative which does not require the use of the discharging dart (40) is to make the spear shaped weapon shaft (12) of a fragile material which will break easily after the spear shaped weapon (10) has penetrated the game. In this case, tracking line (24) is placed inside the spear shaped weapon (10) near one end of the spear shaped weapon (10) and the free end of the tracking line (24) is tied to the opposite internal end of the spear shaped weapon (10). When the spear shaped weapon (10) breaks, the line will begin to feed out. Further, a second approach utilizing a fragile spear shaped weapon (10) would be to use two spools of line placed at the ends of the spear shaped weapon (10) and the two free ends of the tracking lines (24) should be tied together. In this case the tracking line (24) will also begin to feed out when the spear shaped weapon (10) breaks.

Accordingly, tracking line (24) placed inside a spear shaped weapon without any means for expelling the tracking line (24) will adequately track game.

Another case where it will not be necessary to use a discharging dart (40) would be to use a spear shaped weapon tip (14) which detaches from the spear shaped weapon (10). The spear shaped weapon (10) would only penetrate to the extent of the spear shaped weapon tip (14). Once the spear shaped weapon tip (14) has penetrated the game, the spear shaped weapon tip (14) will separate from the spear shaped weapon (10) and the tracking line (24), which is connected to the detachable spear shaped weapon tip (14), will feed out of the spear shaped weapon (10) through the opening vacated by the spear shaped weapon tip (14). This detachable tip method may be useful in situations where deep penetration is not necessary or preferred and also in cases where the game is not intended to be killed.

Figure 5:
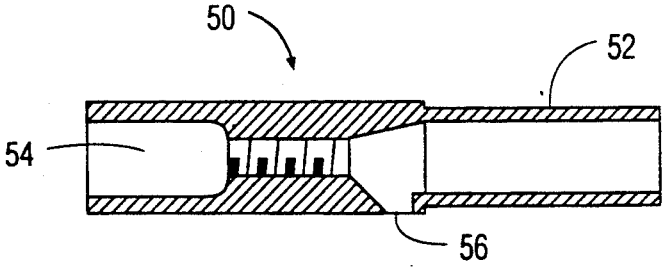
FIG. 5 is a perspective view of a spear shaped weapon front end insert.

FIG. 5 is a perspective view of a spear shaped weapon insert (50). The spear shaped weapon insert (50) can be made of material which is suitable for the respective spear shaped weapon (10) utilized. The spear shaped weapon insert (50) is comprised of the spear shaped weapon insert back (52), the spear shaped weapon insert tip aperture (54) and the spear shaped weapon insert back (52) is a circular hollow tube with a slightly smaller diameter than the spear shaped weapon shaft (12). The spear shaped weapon insert back (52) is inserted in the spear shaped weapon shaft (12). The spear shaped weapon insert tip aperture (54) is a hole with groves on the inside which allows a hunting tip to be inserted and screwed into the spear shaped weapon insert (50). The spear shaped weapon insert trigger line aperture (56) is an aperture which allows the trigger line (22) to flow from within the spear shaped weapon shaft (12) to outside the spear shaped weapon shaft (12).

The spear shaped weapon insert (50), presented herein, can easily be used with all standard arrows and can also be used for most other spear shaped weapon (10). Minor modifications to the spear shaped weapon insert (50) may be necessary in some spear shaped weapons (10) which have unique or peculiar designs. The main purpose of the spear shaped weapon insert (50) is to allow the trigger line (22) to flow in and out of the spear shaped weapon (10) near the front end of the spear shaped weapon (10). Any method which allows the trigger line (22) to flow in and out of the spear shaped weapon (10) near the front end of the spear shaped weapon (10) can be utilized. Another method which can be used to allow the trigger line (22) to flow in and out of the front end of the spear shaped weapon (10) is to have the trigger line (22) flow through an aperture in the spear shaped weapon tip (14). The aperture could go longitudinally through the spear shaped weapon tip insert (16). A second aperture could go through the spear shaped weapon tip base (15) perpendicular to the spear shaped weapon shaft (12). The two apertures would intersect causing a clear passageway in and out of the spear shaped weapon (10) for the trigger line (22). Clearly, many different approaches can be used to enable the trigger line (22) to flow in and out of the front of the spear shaped weapon (10). A third method which could be used to allow the trigger line (22) to flow in and out of the front end of the spear shaped weapon (10) is to place an aperture in the spear shaped weapon shaft (12) at the spear shaped weapon front end of shaft (13).

Figure 8:
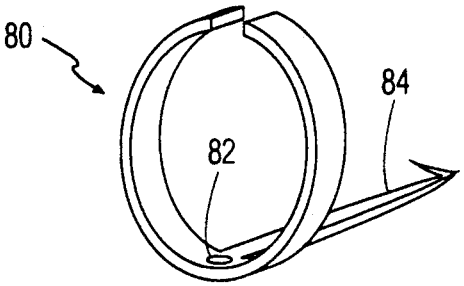
FIG. 8 is a perspective view of a second clip.

The spear shaped weapon trigger line aperture (56) can also be used to allow a second tracking line (24), not presented herein, to feed out of the front of the spear shaped weapon (10). Allowing a second tracking line (24) to feed out of the spear shaped weapon insert trigger line aperture (56) would have significant benefit in cases where the spear shaped weapon (10) falls out of the game after the game is hit and begins to run off. In most cases, when the spear shaped weapon (10) is pulled out, or comes out of the game for any reason, the game will run off and no tracking line would be available for the hunter to follow. In my tracking device a second tracking line (24) will feed out of the spear shaped weapon insert trigger line aperture (56) with the free end of the second tracking line (24) attached to a second clip (80). The second clip (80) would also be attached to the front end of the spear shaped weapon (10) in the same manner as the trigger line clip (60). The second clip (80) will detach from the spear shaped weapon (10) and affix to the game only when the spear shaped weapon (10) is pulled out of the game. One example of a clip which would detach from the spear shaped weapon (10) and affix to the game only when the spear shaped weapon (10) is pulled from the game, is presented in FIG. 8. The second clip which is presented in FIG. 8 is described in more detail later in this section.

FIG. 6 is a perspective view of the trigger line clip (60). The trigger line clip (60) can be made of a material which is suitable for the respective spear shaped weapon (10) utilized. The trigger line clip (60) is comprised of a trigger line clip base (62), a trigger line clip arm (64), a trigger line clip aperture (66), and a trigger line clip split (68). The trigger line clip base (62) has a ring shaped structure with an open section called the trigger line clip split (68). The trigger line clip split (68) allows the trigger line clip base (62) to expand when it is pulled off the spear shaped weapon (10). Upon penetration, the trigger line clip (60) will be pulled off the spear shaped weapon (10). Also attached to the trigger line clip (60), extending perpendicular to the trigger line clip base (62), are trigger line clip arms (64). The ends of the trigger line clip arms (64), which are not attached to the trigger line clip base (62), are folded forward in the same direction as the direction of the spear shaped weapon (10). See FIG. 1 for another view of the trigger line clip arms (64). The trigger line clip arms (64) are folded forward in order to allow the trigger line clip (60) to catch onto the outside of the game which the spear shaped weapon (10) is penetrating. A trigger line clip aperture (66) is placed on the trigger line clip base (62) in order for the trigger line (22) to be attached.

In certain cases the trigger line clip split (68) could be eliminated and accordingly the trigger line clip (60) would be a full circle. If the spear shaped weapon (10) has no spear shaped weapon vanes (18) and/or there is no concern about the amount of penetration, the trigger line clip split (68) may be eliminated.

Figure 7:
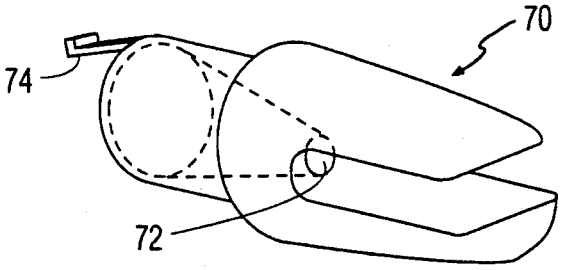
FIG. 7 is a perspective view of a spear shaped weapon tail end.

FIG. 7 is a perspective view of spear shaped weapon tail end (70). The spear shaped weapon tail end (70) can be made of a material which is suitable for the respective spear shaped weapon (10) utilized. The significant features of the spear shaped weapon tail end (70) is the spear shaped weapon tail end aperture (72) and the spear shaped weapon tail end clamp (74). The spear shaped weapon tail end aperture (72) is an aperture of sufficient size to enable the discharging dart (40) to be expelled from inside the spear shaped weapon shaft (12) and to allow the tracking line (24) to feed out of the spear shaped weapon shaft (12). The spear shaped weapon tail end clamp (74) is used to secure the tracking line housing (30) within the spear shaped weapon shaft (12). The spear shaped weapon tail end clamp (74) will preclude any significant longitudinal movement of the tracking line housing (30). The spear shaped weapon tail end clamp (74) may not be necessary if the tracking line housing (30) is held securely enough in the spear shaped weapon shaft (12) to avoid movement. The spear shaped weapon tail end clamp (74) extends from the end of the spear shaped weapon tail end (70) which is internal to the spear shaped weapon shaft (12). The spear shaped weapon tail end clamp (74) is positional parallel to the spear shaped weapon shaft (12). The spear shaped weapon tail end clamp (74) is flexible and has a hook shaped barb at the free end. The barb is small and extends perpendicular to the direction of the spear shaped weapon shaft (12). When my tracking device is positioned inside a spear shaped weapon (10), the tracking line housing (30) is pushed forward in the spear shaped weapon shaft (12). As the tracking line housing (30) is pushed forward, the tracking line housing lip (38) will go under the spear shaped weapon tail end clamp (74) and the clamp barb will secure the tracking line housing (30) in place. Since certain spear shaped weapons (10) have different types of spear shaped weapon tail ends (70), the use of the spear shaped weapon tail end clamp (74) may not be practical in all spear shaped weapons (10). If the spear shaped weapon tail end clamp (74) method is not practical, other methods may be utilized to secure the tracking line housing (30) in place. The other methods include: (a) gluing the tracking line housing (30) in place, (b) placing a donut shaped plug behind the tracking line housing (30) within the spear shaped weapon shaft (12), and (c) making the spear shaped weapon tail end (70) and the tracking line housing (30) a one piece structure.

In certain cases it may be possible for the spear shaped weapon tail end (70) and the tracking line housing (30) to be one piece. This has not been used in the preferred embodiment since this will usually result in the tracking line housing (30) only fitting one size spear shaped weapon (10). In the preferred embodiment the tracking line housing will fit spear shaped weapons of varying sizes.

FIG. 8 is a perspective view of the second clip (80). The second clip (80) can be made of a material which is suitable for the respective spear shaped weapon (10) utilized. The second clip (80) is similar in shaped to the trigger line clip (60) except that the trigger line clip arms (64) are replaced with the second clip shaft (84). The second clip shaft (84) is a long, flat arm with a sharp barbed front end. The second clip shaft (84) lays flat on the spear shaped weapon shaft (12) except for the barb on the second clip shaft (84). The barb at the end of the second clip shaft (84) causes the end of the second clip shaft (84) to be raised slightly from the spear shaped weapon shaft (12). The second clip shaft (84) should point in the direction of the spear shaped weapon tail end (70). The second clip (80) should be placed on the spear shaped weapon shaft (12) close to the spear shaped weapon tip (14). The second clip (80) should be closer to the spear shaped weapon tip (14) than the trigger line clip (60). The second clip aperture (82) will be used to attach a second tracking line free end (25). The purpose of the second clip (80) is to stay attached to the spear shaped weapon shaft (12) when the spear shaped weapon (10) is penetrating the game. Later, the second clip will affix to the game when the spear shaped weapon (10) is pulled out of the game. As the spear shaped weapon (10) is pulled out of the game, the second clip shaft (84) will raise and affix to the inside of the game. The second clip (80) will then separate from the spear shaped weapon (10) and the second tracking line free end (25) will begin to feed out of the spear shaped weapon insert trigger line aperture (56).

FIG. 9 is a perspective view of a trigger line (22). The trigger line (22) is a line with a free end (21) and an opposite end which has a loop (23). The trigger line free end (21) is tied to the trigger line clip (60) at the trigger line clip aperture (66). The trigger line loop (23) should always maintain its loop structure. The loop does not collapse when the trigger line (22) is pulled. Inside the spear shaped weapon, the trigger line loop (23) is detachably inserted in the discharging dart slot (42). The operations and purpose of the trigger line (22) has previously been described in the description of FIG. 2.

From the descriptions above, a number of advantages of my tracking device become evident:

(a) The tracking line is not paid out until after the spear shaped weapon has hit its target.
(b) My tracking device has no exposed lines.
(c) The tracking line pays out of the spear shaped weapon and not from a pay out device which is attached to the launching device.
(d) All the parts to my tracking device are contained on or within the body of the spear shaped weapon.
(e) My tracking device will continue to track game even after the spear shaped weapon has been pulled out of the game.

While my above description contains many specificities, these should not be construed as limitations on the scope of the invention, but rather as an exemplification of one preferred embodiment thereof. Many other variations are possible. Some examples of other variations have been explained above.

Thus, the scope of the invention should be determined not by the embodiments illustrated, but by the appended claims and their legal equivalents.

I claim:

1. An arrow having means for activating a device, said device being connected to the arrow and being exposed to the outside of the arrow and said activating means comprising:

(a) clip means movably connected to the exterior of the arrow for catching engaging an object when the arrow penetrates such object, (b) a trigger line, said trigger line connected at one end to said clip means and connected at the other end to the device, (c) means for removably securing the trigger line to the device, (d) whereby when said arrow penetrates an object said clip means engages the object and as the arrow continues to penetrate the object the clip means pulls the trigger line and the trigger line pulls the device causing said device to activate.

2. The arrow of claim 1 wherein said arrow is comprised of a shaft and an arrowhead at one end of the shaft.

3. The arrow of claim 2 wherein said arrow further includes an arrow nock at the end of the arrow shaft opposite the arrowhead.

4. The arrow of claim 1 wherein the clip means is removably connected to the exterior of the arrow.

5. The arrow of claim 1 wherein the clip means is slidably connected to the exterior of the arrow.

6. The arrow of claim 1 wherein the length of the trigger line is changeable whereby the device can be activated at a predetermined point during the penetration of the arrow.

7. The arrow of claim 1 wherein the position of the clip means on the arrow is changeable whereby the device can be activated at a predetermined point during the penetration of the arrow.

8. The arrow of claim 1 further including a direction altering means, said trigger line extending from said clip means extending to said direction altering means, being looped around said direction altering means and extending therefrom to said device.

9. The arrow of claim 1 wherein said arrow has a hollow interior, said device being positioned in the interior of the arrow, and said hollow arrow further comprising:

(a) a hole in said hollow arrow communicating between the interior and the exterior of the arrow, (b) said trigger line connected at one end to said clip means, extending through said hole to the interior of the arrow, extending through said arrow and secured to the device, (c) means for removably securing the trigger line to the device, (d) whereby when said arrow penetrates an object said clip means engages the object and as the arrow continues to penetrate the object the clip means pulls the trigger line from the arrow through said hole and the trigger line pulls the device causing said device to activate.

10. The arrow of claim 9 including a direction altering means in said arrow, said trigger line being connected at one end to said clip means, extending through said hole to the interior of the arrow, extending to said direction altering means, being looped around said direction altering means, extending in the direction of the device and being connected to said device with said means for removably securing said trigger line.

11. The arrow of claim 10 wherein, (a) said arrow is comprised of an arrow shaft and an arrow head, (b) said hole in said arrow is adjacent said arrowhead, (c) said arrow shaft further including an aperture at the end opposite the arrowhead, said aperture communicates between the hollow interior of the arrow and the exterior of the arrow, (d) said device comprising an elongate mass positioned in said shaft and having a cross sectional area less than the cross sectional area of the aperture in the arrow whereby it mass pass through said aperture to the exterior of the arrow, said elongate mass having a notch therein adjacent its end which faces the arrowhead, (e) said trigger line direction altering means positioned in said arrow adjacent its end opposite the arrowhead, (f) said trigger line being connected at one end to said clip means, extending through said hole to the interior of the arrow, extending rearwardly through said arrow to said direction altering means, being looped around said direction altering means and extending forwardly therefrom to said notch in said elongate mass, and being removably secured in said notch, (g) whereby when said arrow penetrates an object at which it is shot said clip means engages the object and as the arrow continues to penetrate the object the clip pulls the trigger line from the arrow through said hole and the trigger line pulls the elongate mass rearwardly through the aperture to the exterior of the arrow.

12. The arrow of claim 11 further including a supply of tracking line positioned in said arrow between the arrowhead and the elongate mass, one end of the tracking line being attached to the elongate mass and a second end comprised of a supply of tracking line, whereby when said arrow penetrates the hide of a game animal at which it is shot said clip engages the hide and as the arrow continues to penetrate the animal the clip pulls the trigger line from the arrow through said hole and the trigger line pulls the elongate mass rearwardly through the aperture in the tail end to the exterior of the arrow causing the tracking line to be pulled from the arrow.

13. The game tracking arrow of claim 12 wherein the aperture in the tail end of the arrow shaft is a longitudinal bore extending centrally through a bow string engaging notch.

14. The game tracking arrow of claim 12 wherein one end of the tracking line is attached to the elongate mass and the other end is fastened to the arrow.

* * * * *